US008760280B2

(12) United States Patent
Piccolo, III

(10) Patent No.: US 8,760,280 B2
(45) Date of Patent: Jun. 24, 2014

(54) METHOD AND APPARATUS FOR COMMUNICATING WITH NON-ADDRESSABLE NOTIFICATION APPLIANCES

(75) Inventor: Joseph Piccolo, III, Fitzwilliam, NH (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 327 days.

(21) Appl. No.: 13/193,304

(22) Filed: Jul. 28, 2011

(65) Prior Publication Data

US 2013/0027198 A1 Jan. 31, 2013

(51) Int. Cl.
*G08B 29/00* (2006.01)

(52) U.S. Cl.
USPC ..... 340/506; 340/577; 340/628; 340/691.1; 307/117

(58) Field of Classification Search
USPC ..... 340/506, 577, 628, 691.1, 286.05, 505, 340/815.4, 6.1, 691.6, 3.5, 3.52; 307/117
See application file for complete search history.

(56) References Cited

U.S. PATENT DOCUMENTS

| | | | | |
|---|---|---|---|---|
| 5,402,101 | A * | 3/1995 | Berger et al. | 340/286.02 |
| 6,281,789 | B1 * | 8/2001 | Furtado et al. | 340/506 |
| 6,313,744 | B1 | 11/2001 | Capowski et al. | |
| 6,426,697 | B1 | 7/2002 | Capowski et al. | |
| 7,369,037 | B2 | 5/2008 | Piccolo, III et al. | |
| 7,999,692 | B2 * | 8/2011 | Sendrowski, Jr. | 340/691.1 |
| 8,138,928 | B2 | 3/2012 | Farley et al. | |
| 8,378,806 | B2 * | 2/2013 | Piccolo, III | 340/501 |
| 2008/0258924 | A1 * | 10/2008 | Moss | 340/577 |
| 2008/0266064 | A1 * | 10/2008 | Curran et al. | 340/293 |
| 2009/0091466 | A1 | 4/2009 | Sendrowski, Jr. | |
| 2010/0315224 | A1 | 12/2010 | Orsini et al. | |
| 2012/0154160 | A1 * | 6/2012 | Piccolo, III | 340/628 |

FOREIGN PATENT DOCUMENTS

| | | | |
|---|---|---|---|
| WO | WO2004028115 | A | 4/2004 |
| WO | WO2009010745 | A | 1/2009 |

* cited by examiner

*Primary Examiner* — Eric M Blount
(74) *Attorney, Agent, or Firm* — Brinks Gilson & Lione

(57) ABSTRACT

A non-addressable fire alarm system, with a fire alarm control panel and one or more non-addressable devices, is provided. The fire alarm control panel sends a broadcast command to the one or more non-addressable devices in the fire alarm system. In response thereto, the one or more non-addressable device modify at least one aspect of one or more communication lines in the fire alarm system. For example, the non-addressable device may generate an open circuit, a closed circuit, or put a current on the one or more communication lines. As another example, the non-addressable device may send a communication back to the fire alarm control panel.

23 Claims, 5 Drawing Sheets

METHOD AND APPARATUS FOR COMMUNICATING WITH NON-ADDRESSABLE NOTIFICATION APPLIANCES

BACKGROUND

Typical fire alarm systems include a number of fire/smoke detectors positioned throughout a building (and/or campus). Signals from those detectors are monitored by a system controller, such as a fire alarm control panel ("FACP"). The FACP, upon sensing an alarm condition, sends commands to one or more notification appliances to alert occupants in one section of the building, in multiple sections of the building, in all sections of the building or in some or all sections of the campus. Notification appliances can output a visual notification, an audible notification, or both. Examples of notification appliances include, but are not limited to strobes, horns, speakers, and the like. Notification appliances are typically connected across common power lines on a notification appliance circuit ("NAC").

Fire alarm systems NACs may be classified as: (1) including non-addressable notification appliances ("non-addressable NAG"); and (2) including addressable notification appliances ("addressable NAC"). Non-addressable notification appliances do not have an address, and, therefore, the FACP cannot communicate with a particular notification appliance. All of the non-addressable notification appliances on a single circuit are activated at the same time, for example by applying power to the circuit. In the addressable system, on the other hand, each notification appliance has a uniquely assigned address, enabling the FACP to send communications to and receive communications from a particular notification appliance.

Each type of fire alarm system has benefits and drawbacks, such as in terms of installation, configuration, and operation. With regard to installation, the non-addressable alarm system is typically more expensive to install in terms of wiring than an addressable alarm system. The non-addressable alarm system is bound to the particular wiring of the system, e.g. a single loop of wiring or linear wiring with each appliance wired in series, so that the wiring may be supervised for open circuit faults. Also, due to the lack of uniquely assigned addresses, notification appliances need to be wired to the proper NAC in order, to be properly activated by the FACP. In contrast, an addressable alarm system may be installed without regard to the particular wiring in a building since each appliance is individually supervised to detect open circuit faults. In this way, the installer may lay the wiring as is most convenient (such as by using "T" taps).

With regard to configuration, the addressable alarm system requires much more manpower than the non-addressable alarm system. For example, configuration of the addressable alarm system requires setting a unique address at each notification appliance (such as through switches or other type of means). As another example, configuration of the addressable alarm system requires entering device identification information (such as a label) for each notification appliance. As still another example, configuration of the addressable alarm system may require grouping of the notification appliances. Unlike non-addressable notification appliances (which are activated by modifying the power to the NAC to which they are connected), addressable notification appliances need not be grouped based on wiring. Instead, the group(s) to which each addressable notification appliance is to be assigned may be manually designated so that the FACP can simultaneously turn a group of addressable notification appliances on/off at the proper times. Such a grouping is called a virtual NAC ("VNAC"), with each of the addressable notification appliances in the VNAC being "turned on" by the FACP, preferably using a single group-directed command. Using the grouping may make installation of the fire alarm system easier. The manually designated grouping may be used instead of (or in addition to) setting of addresses. For example, in one embodiment, the operator may input grouping information on one or more notification appliances. The FACP may use the grouping information in order to group the appliances. So that, the operator need not input unique address information on the one or more notification appliances, thereby making setup of the fire alarm system easier.

With regard to operation, the addressable alarm system has advantages over the non-addressable alarm system. As merely one example, advanced diagnostics are available in the addressable alarm system but are not available in the non-addressable alarm system. For example, the FACP may send a command to an addressable notification appliance to perform a self-test. The addressed notification appliance may perform the self test, and then report back the results of the test to the FACP. In contrast, in a non-addressable system, the FACP can only communicate with non-addressable notification appliances via one of two methods: (1) FACP applies power to the NAC and all of the notification appliances on the NAC turn on and operate; or (2) FACP applies power to the NAC and sends a communication signal on the power line to control the notification appliances in a very limited fashion (ON, OFF, SILENCE). In this way, more advanced operations are unavailable.

Even though installation is easier and operation is better using an addressable alarm system, a majority of fire alarm systems are non-addressable because configuring an addressable alarm system is so much more time-consuming and expensive.

SUMMARY

A non-addressable fire alarm system, with a fire alarm control panel and one or more notification appliance circuits, is provided. In one embodiment, the fire alarm control panel sends a broadcast command to the one or more appliance circuits in the fire alarm system. One or more non-addressable appliances on the one or more appliance circuits receive the broadcast command, and in response thereto, modify at least one aspect of one or more communication lines in the fire alarm system.

In one aspect, the non-addressable appliances may modify the one or more communication lines by creating an open circuit on the one or more communication lines. For example, the non-addressable appliance may receive a broadcast test command. The broadcast test command may be indicative of instructing the non-addressable appliance to test at least one aspect of the non-addressable appliance, and to modify the one or more communication lines based on the results of the test (such as creating an open circuit on the one or more communication lines if a fault is determined based on the test). The fire alarm system may include a device to sense the one or more communication lines to determine the state of the one or more communication lines. For example, the fire alarm system may include an end-of-line device to sense whether there is an open circuit on the one or more communication lines. The end-of-line device, which may comprise a sensor, may send the sensed output to the fire control panel in order for the fire alarm control panel to determine whether there is a fault on one or more of the appliances in the appliance circuit. Alternatively, the end-of-line device may be integral with the fire alarm control panel.

In another aspect, the non-addressable appliances may modify the one or more communication lines by sending a communication back to the fire alarm control panel. The fire alarm control panel, in turn, may receive the communication and act accordingly. Because the appliances are non-addressable, the communications sent back to the fire alarm control panel may clash. To reduce the possibility of a clash in communications, one, some, or all of the appliances may modify the timing when the communications are sent to the fire alarm control panel. For example, one, some, or all of the appliances may generate a random number, and then may send the communication based on the generated random number. In this way, the sending of the communication based on the random number may reduce the likelihood of a clash of communications. In addition, or in the alternative, the fire alarm control panel may send a subsequent broadcast communication in the event of a clash. For example, in the event that the fire alarm control panel determines there is a clash, the fire alarm control panel may send a subsequent broadcast command instructing the notification appliances to resend the communication. In response to receiving the subsequent broadcast command, the notification appliances that just sent the communications which resulted in the clash may independently generate new random numbers, and re-send the communications with delays based on the new random numbers.

In another embodiment, the fire alarm control panel is configured to send one or more non-alarm type of broadcast messages. As one example, the fire alarm control panel is configured to send a mass notification broadcast message and/or a fire alarm notification broadcast message. The fire alarm system may include mass notification appliances and fire alarm notification appliances on the same one or more communication lines. The fire alarm control panel may send the mass notification broadcast message and/or the fire alarm notification broadcast message on the one or more communication lines. In the case of the mass notification broadcast message, the non-addressable appliances connected to the one or more communication lines receive the mass notification broadcast message. In response to receiving the mass notification broadcast message, the mass notification appliances may determine whether they are mass notification appliances (such as by checking previous programming indicating that they are mass notification appliances). In response to determining that an appliance is a mass notification appliance, the appliance may perform at least one action (such as performing an action as indicated in the mass notification broadcast command, or such as performing an action in a subsequent command).

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION

Figure 1:
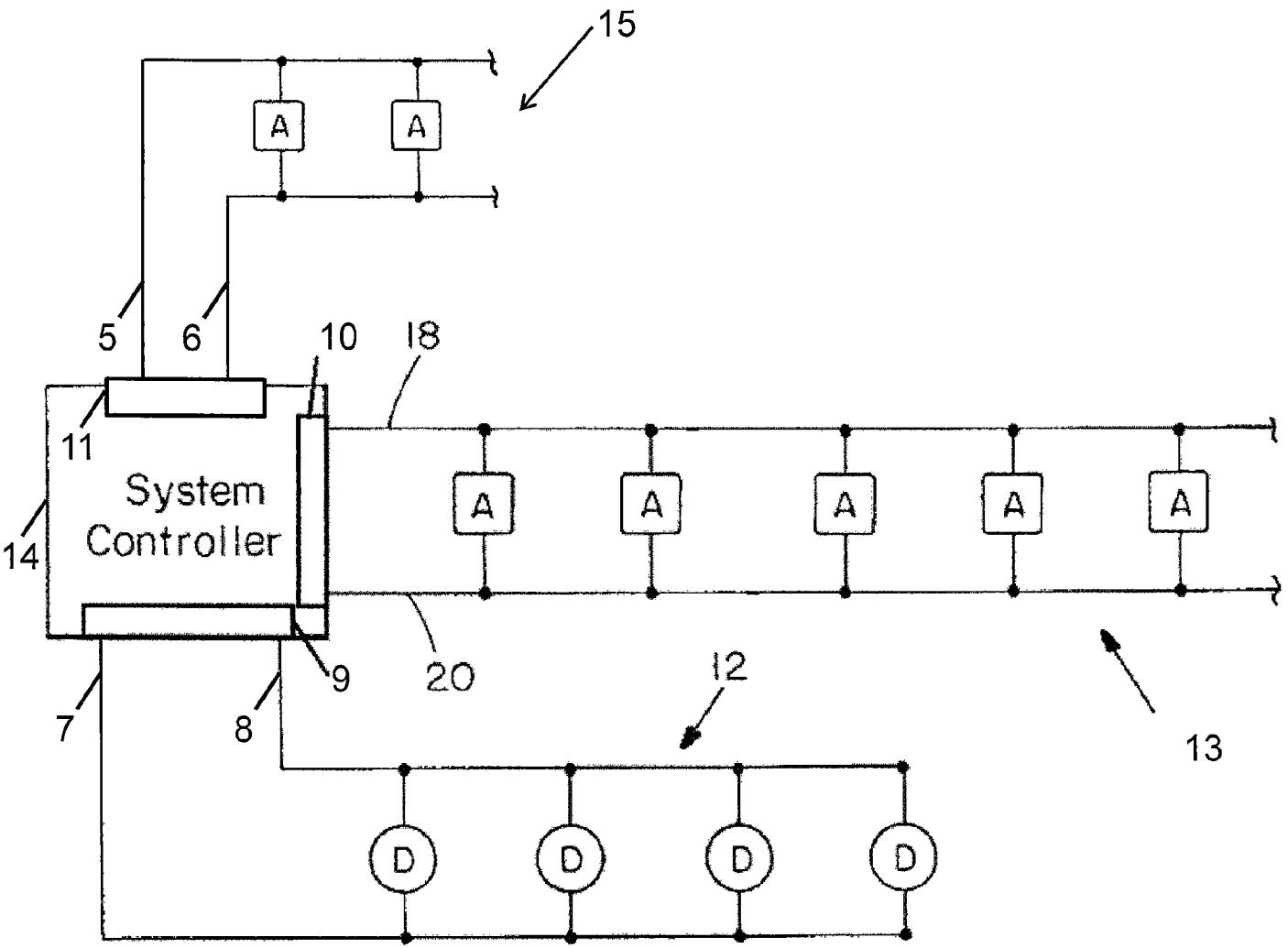
FIG. 1 is a schematic diagram illustrating a system configuration.

A system embodying one example of the present invention is illustrated in FIG. 1. The system includes a system controller 14 (such as a fire alarm control panel (FACP)), alarm condition detectors D, and alarm system notification appliances A. The system may be configured in different ways, such as depicted in FIG. 1.

One, some, or all of the alarm condition detectors D and/or the alarm system notification appliances A may be non-addressable. An addressable device may include a device that has a unique identification (unique ID) within the system. In this way, the system controller 14 may communicate with the device that has the unique ID. For example, in an addressable system, the system controller 14 may send a communication with the unique ID in one or more fields of the communication. The device that receives the communication may determine that the communication includes the unique ID and respond accordingly. As another example, in an addressable system, the device may send a communication to the system controller 14 with the unique ID in one or more fields of the communication. A non-addressable appliance may not have a unique ID for the system. The system controller 14 may send broadcast commands to the non-addressable appliances, with the broadcast commands not including any identification unique to any of the appliances in the system.

FIG. 1 further depicts two notification appliance circuits (NAC) 13, 15. However, a fewer or a greater number of notification appliance circuits may be used in the alarm system. FIG. 1 further depicts one detector circuit 12. However, a greater number of detector circuits may be used in the alarm system. The appliance circuits 13, and the detector circuit 12 include one or more wires that emanate from interfaces 9, 10, 11 of the system controller 14. More specifically, one, some, or all of the wiring for an appliance circuit may emanate from a NAC or detector loop interface 9, 10, or 11 of the system controller 14. As discussed below, the wiring emanating from the interface may be used in the communication with the notification appliances and/or the detectors described herein.

The example in FIG. 1 depicts that all of the notification devices on a signal output circuit are coupled across a pair of power lines, such as 5 and 6, 18 and 20, although this is not necessary for carrying out the invention. Lines 5 and 6 may carry communications between the system controller 14 and notification appliances A on appliance circuit 15. Lines 18 and 20 may carry communications between the system controller 14 and notification appliances A on notification appliance circuit 13. Moreover, lines 7 and 8 may carry communications between the system controller 14 and detectors D on detector circuit 12.

The circuits may have alarm condition detectors D, alarm system notification appliances A, or both alarm condition detectors D and alarm system notification appliances A. For example, FIG. 1 depicts detector circuit (DC) 12 that includes alarm condition detectors D. Though FIG. 1 depicts only a single detector circuit 12, multiple detector circuits may be included in the system configuration. As still another example, FIG. 1 depicts two notification appliance circuits 13, 15 that includes alarm system notification appliances A. As still another example, the alarm system may include a detector/notification appliance circuit (D/NAC) that includes both alarm condition detectors A and alarm system notification appliances A. Again, FIG. 1 is merely for illustration purposes. Fewer or greater numbers of appliance circuits may be used, fewer or greater NACs may be used, fewer or greater DCs may be used, and, one or multiple D/NACs may be used.

The system controller 14 may monitor the alarm condition detectors D. When an alarm condition is sensed, the system controller 14 may signal the alarm to the appropriate notification appliances A through the one or more appliance circuits. Notification devices may include, for example, a visual alarm (such as a strobe), an audible alarm (such as a horn or speaker), or a combination thereof. A visible indicator (such as an LED) may be provided on any of the above-described notification appliances A, with the LED also being controlled by the system controller 14. For example, the LED may be operated under NAC commands (described below) such that the LED blinks every time the notification appliance A is polled (such as a broadcast command that indicates a request to poll).

The system controller 14 may use one or more commands to signal the alarm to the appropriate notification appliances A. Examples of commands issued for a system with addressable notification appliances are disclosed in U.S. Pat. No. 6,426,697, which is hereby incorporated by reference in its entirety. Further, the system controller 14 may send one or more commands relating to diagnostics, status, or other non-alarm type events. For example the system controller 14 may send a command related to the identification, the configuration, and/or the status of the notification appliances A. And, the notification appliances A may respond in kind.

The command from the system controller 14 can, for example, be superimposed or multiplexed onto the device's power line (such as lines 18 and 20), providing the added benefit that it saves the cost of additional wiring to devices. Alternatively, the communication line to the device may be separate from the power line. The communications channel may comprise, for example, a wireless link, a wired link or a fiber optic link.

Figure 2:
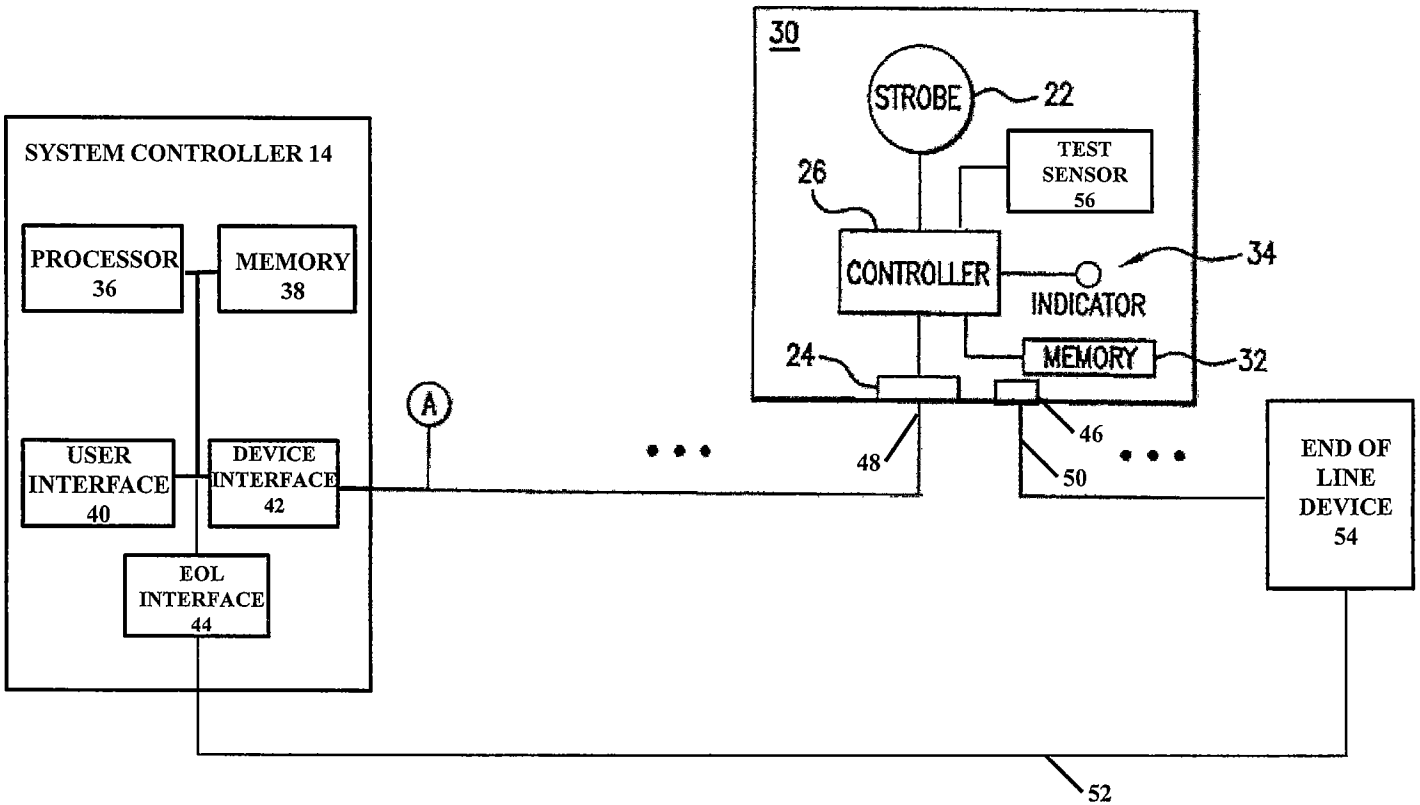
FIG. 2 is a schematic diagram of a part of the system shown FIG. 1, further illustrating details of the system controller and one of the notification appliances.

FIG. 2 is a schematic diagram of a part of the system shown in FIG. 1, further illustrating details of the system controller 14 and one of the notification appliances. The system controller 14 includes a processor 36, a memory 38, a user interface 40, a device interface 42, and an end-of-line (EOL) interface 44. The processor 36 may comprise a microprocessor, a microcontroller, a digital signal processor, an application specific integrated circuit (ASIC), a field programmable gate array, a logical digital circuit, or other now known or later developed logical processing capability. The processor 36 may work in combination with the memory 38 in order to monitor part or all of the fire alarm system, including one or more of the appliance circuits (such as one or more notification appliance circuits, one or more detector circuits, and one or more notification appliance/detector circuits). In addition, the memory may include one or more look-up tables (or other data structures) used for configuration. Though not necessary to practice the invention, a look-up table correlating the input/output ports 9, 10, 11 to the areas of the building may be stored in memory 38 (such as correlated to $1^{st}$ Floor, $2^{nd}$ Floor, and $3^{rd}$ Floor, respectively). This look-up table may be manually entered.

User interface 40 may be used by an operator to control configuration and/or operation of the alarm condition detectors D and alarm system notification appliances A. And, device interface 42 may be an example of a communications interface, and may comprise the interface between the system controller 14 and the alarm condition detectors D and alarm system notification appliances A in the one or more appliance circuits. For example, device interface 42 may include one or multiple input/output ports (such as illustrated as 9, 10, 11 in FIG. 1).

FIG. 2 depicts a strobe device 30 in greater detail. However, the illustration of strobe device 30 is merely for illustration purposes. Other alarm system notification appliances A, or alarm condition detectors D may be used. Strobe device 30 connects to the appliance circuit via line 48 input to a communication interface (such as a loop interface) 24. A controller 26, such as a microcontroller or hardwired logic, receives from and sends to the system controller 14 communications. When commanded by the system controller 14, the strobe 22 of strobe device 30 flashes at a configured setting, which may be stored in a memory (volatile or non-volatile) 32. Although shown separately, the memory 32 may be integrated with the controller 26. As discussed in more detail below, the strobe device 30 may receive broadcast commands on line 48 via communication interface 24. The broadcast command may include one or more codes indicating the type of broadcast command. The controller 26 of the strobe device 30 may interpret the commands using a look-up table or other data structure that correlates the code in the broadcast command with the requested action. For example, a broadcast test command may include a particular code (such as a particular series of "0" and "1"). The look-up table may correlate the particular series of "0" and "1" with a series of actions (such as performing a series of actions to perform the test) or with an internal code that the controller 26 recognizes as a test command. As another example, a broadcast mass notification command may include a different code (such as a different series of "0" and "1"). the lookup table may correlate the different series of "0" and "1" with an internal code that the controller 26 recognizes as a mass notification command.

In some embodiments, an indicator 34, such as a flashing LED, may be used as an output, for example during diagnostic testing, on the strobe device 30. The indicator 34 may be activated, for example, upon command from the system controller 14, upon a local manual command such as a pushbutton (not shown), on a periodic basis, always, or upon some other event, as discussed below.

Strobe device 30 may further be connected to line 50 so that the strobe device 30 may be connected to additional devices down the line of the appliance circuit. In one aspect, the strobe device 30 may modify one or more of the communication lines (such as line 48 and/or line 50). For example, strobe device 30 may change the current that ordinarily runs through line 50. In particular, under ordinary operation, there is a reverse polarity supervision current. The strobe device 30 may modify the current in the line, such opening the line, or modifying the current on the line (so that it is different from the reverse polarity supervision current). In the example of modifying the current on the line, the strobe device 30 may generate current and superimpose it onto one or more of the communication lines. The amount of the current limit may be set so that it is in between an open circuit and a short circuit. In this way, the set current may be selected so that the system controller 14 identifies the set current. The set current may also be selected such that if all of the notification appliances in the appliance circuit are setting its current, the sum of all currents does not exceed the threshold for detecting a short circuit.

Further, the modification of the one or more communication lines may be static or dynamic. For example, the strobe device 30 may modify the communication line (whether open circuit, current-limited condition that is different from normal operation (e.g., using a current sink to modify the range of current limiting on the communication line), or addition of a current) until it receives an input (such as a manual input at the notification appliance) or a broadcast communication from the system controller 14. As another example, the strobe device 30 may modify the communication line for a predetermined period of time (such as for one or multiple seconds, or for a pulse (on the order of nanoseconds or milliseconds).

As one example, strobe device 30 may further include an isolator 46 to which line 50 is connected. Isolator 46 may be used to generate an open circuit on line 50, thereby opening line 50. In effect, isolator 46 disconnects other notification appliances wired further along the appliance circuit so that the downstream devices lose power. Alternatively, a relay may be used to generate an open circuit on line 50. Isolator 46 and relay are merely two examples of an open circuit generating device. Other examples open circuit generating devices are contemplated. In this way, the isolator 46 may disconnect the strobe 30 (or other device) from the circuit. As discussed in more detail below, an end-of-line device 54 may provide the system controller 14 with information whether there is an open circuit on line 50. For example, the end-of-line device 54 may provide input as to an amount of current on line 50. If the current is below a predetermined amount, the system controller 14 may conclude that there is an open circuit.

The end-of-line device 54 may comprise a resistor, and may establish a circuit when the voltage on the line is in reverse polarity, i.e., the device stops drawing current when the voltage is reversed and so the current is simply the result of the voltage on the circuit, the EOL, and the wire resistance. Knowing the circuit is "good" or operating normally may be done by measuring the current and the system controller 14 verifying that the current falls within the expected range given the variability of wiring that is allowed. The end-of-line device 54 may communicate with the system controller 14 via line 52 to EOL interface 44. Alternatively, end-of-line device 54 may communicate wirelessly with system controller 14.

As discussed in the background, the fire alarm control panel applies power to the NAC and sends a communication signal on the power line to control the notification appliances in a very limited fashion (ON, OFF, SILENCE). In this way, communication is only in one direction—from the fire alarm control panel to the notification appliances. Moreover, the fire alarm control panel can only send rudimentary commands to the non-addressable notification appliances.

In one aspect, in response to receiving a broadcast communication, the non-addressable appliances may modify one or more of the communication lines in order to provide feedback in response to receiving the broadcast communication. As one example, the modification of the one or more communication lines may include opening the circuit, for example generating an open circuit on the one or more communication lines, such as discussed in FIG. 3. The open circuit may be sensed by a device (such as an end-of-line device that sends input to the system controller 14 to determine the open circuit). As another example, the modification may be that the appliance sends a communication on the one or more communication lines. The system controller 14 may then receive the communication, as discussed in FIGS. 4 and 5. By modifying the one or more communication lines in some way, the appliances may at least partially automatically communicate with the system controller 14, even though the appliances are not addressable.

As discussed above, the appliances may modify one or more of the communication lines in response to receiving a command. There are a multitude of complex commands that can be sent to the appliances under this methodology, as discussed below. One type of broadcast command is a non-alarm type of command. For example, the system controller 14 can send a test command.

The system controller 14 may broadcast a test command via one circuit or loop (such as to one of 12, 13, or 15), to some of the circuits, or to all of the circuits. The broadcast test command may encode a code onto the lines (such as lines 5 and 6, 7 and 8, or 18 and 20). The code may be an indication to test. So that, when an appliance on an appliance circuit receives the code, the appliance may perform a test, such as by using test sensor 56. The test sensor 56 may comprise a sensor that tests one or more aspects of the appliance. For a strobe appliance, the test sensor 56 may comprise a light sensor. For a horn appliance, the test sensor 56 may comprise an audio sensor. The test may instruct the appliance to generate an output. The output generated may be similar to an alarm notification output (such as activating the strobe 22 of strobe device at an intensity similar to an alarm event, activating the horn for a horn device at a volume similar to an alarm event, etc.). Alternatively, the output generated may be different from an alarm notification output (such as activating the strobe 22 of strobe device at an intensity lower than or at a duration less than for an alarm event, activating the horn for a horn device at a volume lower than or at a duration less than for an alarm event, activating an output different from the alarm notification output, such as an LED on the appliance).

One example of a test is a command for the device to enter one or more test modes for non-intrusive testing. In the non-intrusive testing mode, the device may only light a predetermined type of output (such as activate an LED or other type of non-intrusive light). Alternatively, in the non-intrusive testing mode, the device may remain silent until receiving a manual input (such as receiving a touch, or sensing proximity of a magnet, thereby activating a magnet switch on the device). After receiving the manual input, the device may generate an output (such as beep and/or flash) for a predetermined period of time (such as 2 seconds). The self test command or the one or more test modes may be used by both detectors and/or notification appliances.

Figure 3:
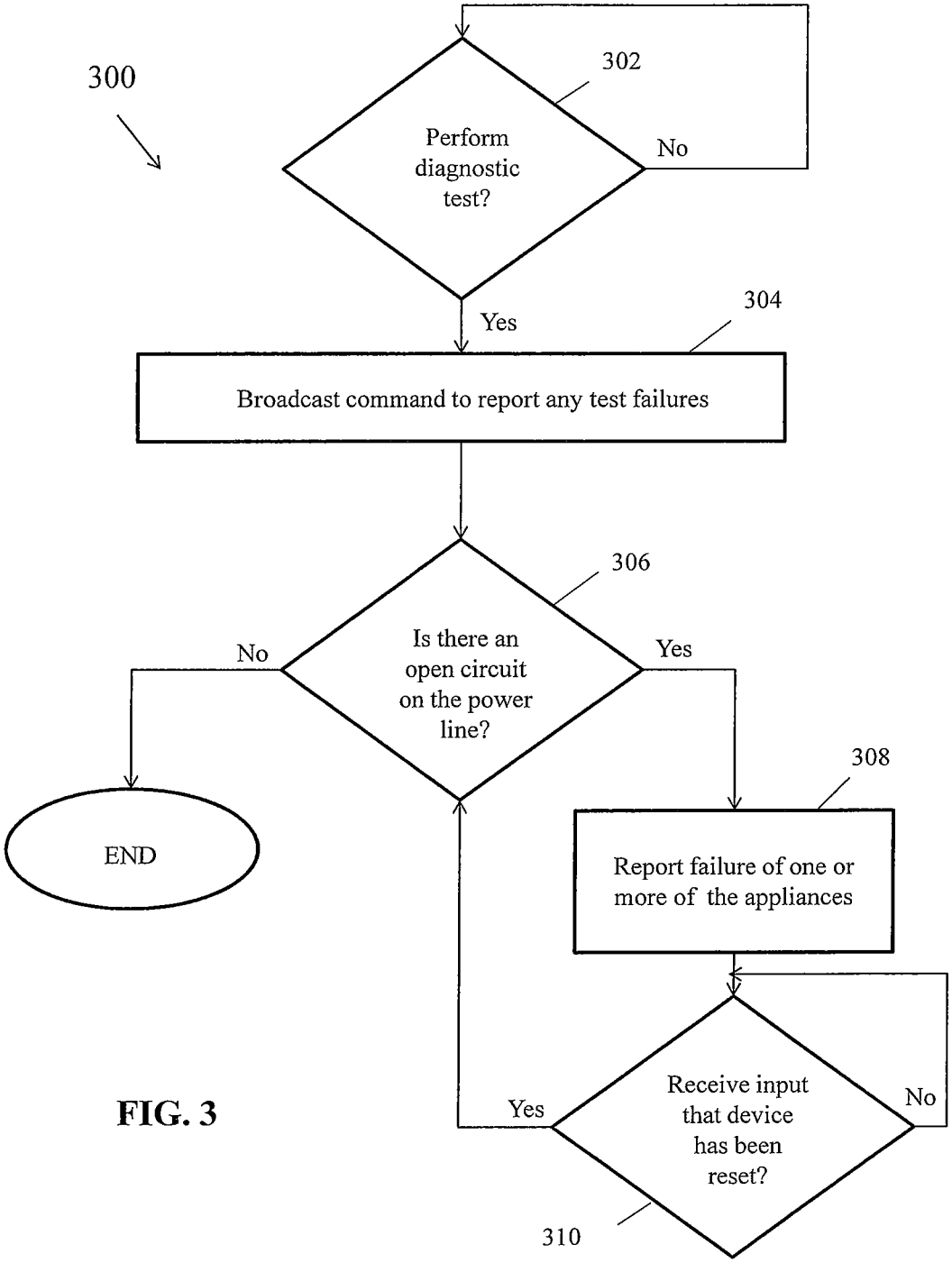
FIG. 3 illustrates a flow chart of one example of the system controller overseeing one, some or all of the appliances in the system to perform a test.

FIG. 3 is a flow chart 300 of one example of the system controller 14 overseeing one, some or all of the appliances in the system to perform a test. The example of the broadcast command being a test is merely for illustrative purposes. Other broadcast commands (such as other non-alarm type commands) are contemplated.

As shown at block 302, the system controller 14 determines whether to perform a diagnostic test. If not, the system controller 14 loops back to block 302. If so, the system controller 14 configures a command to broadcast, as shown at block 304. The command may have one or more fields, with a command code included in one of the fields. The command code indicates to the receiving appliance to perform a test, and to report any failures in performing the test.

The appliance, in response to receiving the broadcast command at communication interface 24, decodes the broadcast command to determine the code within the broadcast command, and perform one or more tests in response to receipt of the broadcast command. Further, the appliance may indicate the results of the test (such as whether the appliance is performing normally or whether the appliance is faulty). For example, if the appliance determines that there are one or more problems resulting from performing the tests, the appliance may generate and send to the system controller 14 an indication of the problem. The appliance may indicate the problem by modifying one or more of the communication lines (such as opening the circuit on one or more of the communication lines, as discussed below). Alternatively or in addition to modifying the one or more communication lines the appliance may modify one or more aspects of the output of the appliance. For example, the appliance may activate its primary output, such as activating strobe 22 for strobe device 30, horn for a horn device, etc. As another example, the appliance may activate a secondary output, such as indicator 34 (or other light) for strobe device 30. An operator may then walk around a building, for example, to determine whether any of the appliances are activating an output.

There are several ways by which to modify one or more of the communication lines to indicate the results of the test. For example, the appliance may use isolator 46 to modify line 50, such as by opening the circuit on line 50 using isolator 46. The end-of-line device 54 may sense the open circuit and report the result to the system controller. In this way, the system controller 14 may automatically sense feedback from at least one of the appliances in response to the broadcast message. For example, the system controller 14 may sense whether there is an open circuit on the power line, as shown at block 306. In the instance where the appliance only activates the isolator 46 when the appliance determines that the test indicates a problem with the appliance, the system controller 14 may determine that if there is no open circuit on the power line, the test may end, thereby indicating that there are "no current test failures".

If the system controller 14 determines that there is an open circuit, the system controller 14 may report that there is a failure of one or more of the appliances, as shown at block 308. An operator may then search the appliance circuit to determine which appliance is faulty. As discussed above, the faulty appliance may activate an output (such as an LED) to indicate a fault. Further, as discussed above, the system controller 14 may test one appliance circuit at a time. The system controller 14 may also determine the area which the appliance circuit resides, such as using the look-up table correlating the input/output ports 9, 10, 11 to the areas of the building (such as correlated to $1^{st}$ Floor, $2^{nd}$ Floor, and $3^{rd}$ Floor, respectively). In this way, the system controller 14 may report to the operator that the appliance reporting the error is in a particular area of the building, such as the $2^{nd}$ floor. The operator may walk to the particular area to determine which of the appliances is generating an output. The operator may then provide an input to the appliance (such as manually pressing a button on the appliance, placing a magnet proximate to the appliance, or sending a wireless signal/command to the appliance). In response to receiving the input from the operator, the appliance may deactivate isolator 46 so that line 50 is not an open circuit.

As shown in FIG. 2, there may be multiple appliances on a single appliance circuit. In the event that there are multiple appliances that are reporting failures, the multiple appliances will have activated their respective isolators to open the circuit. After the operator has reset the appliance (such as by providing input), the operator may send input to the system controller 14 that the appliance has been reset, as shown at block 310. The system controller 14 may then check again whether there is an open circuit on the power line, as shown at block 306. If not, then the appliance that was reset is the only appliance that reported an error. If there is still an open circuit on the power line, then there is another appliance that is reporting an error, and blocks 308 and 310 are repeated.

Figure 4:
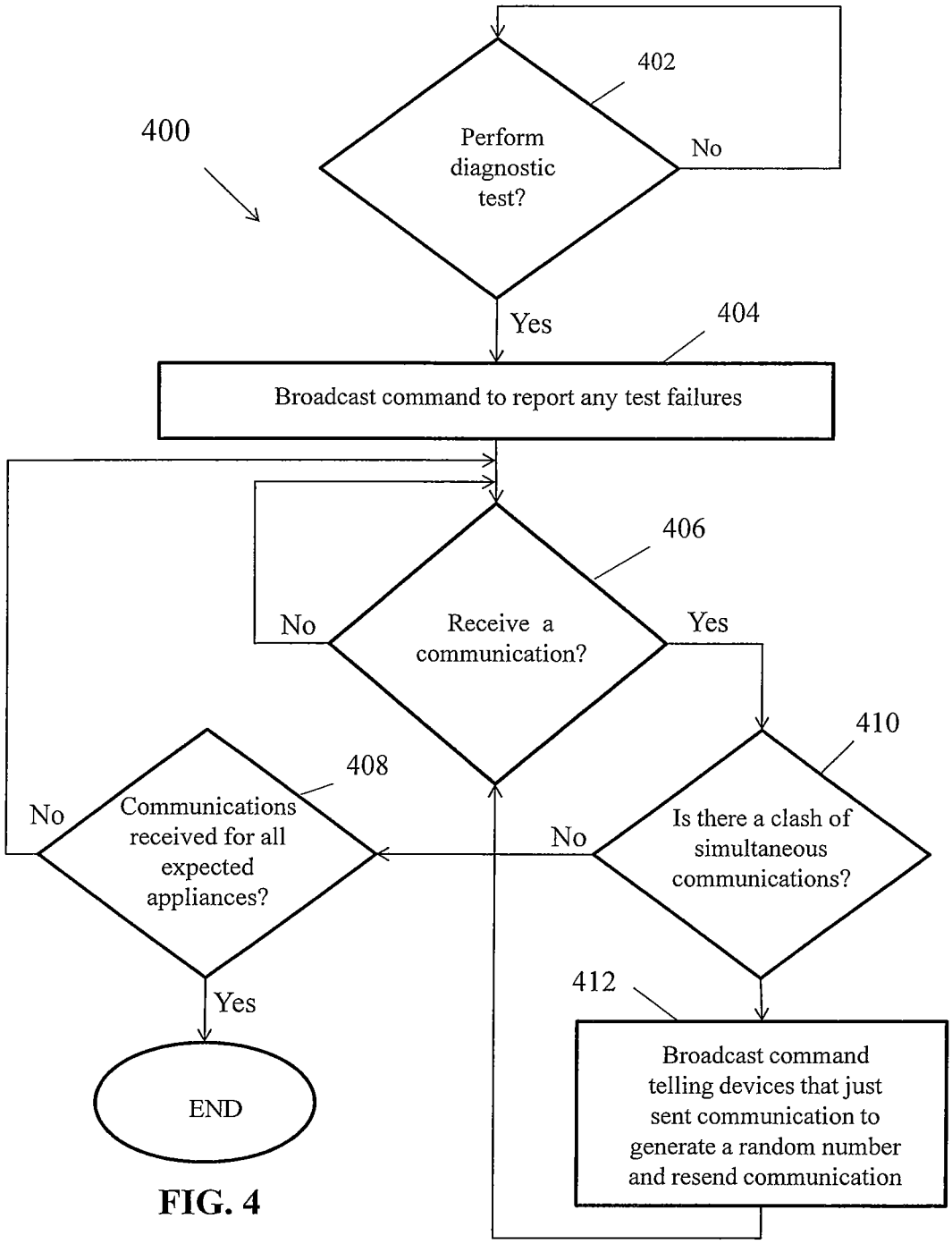
FIG. 4 illustrates a flow chart of an example of the system controller broadcasting a command to the non-addressable appliances and receiving/interpreting the responses from the non-addressable appliances.
Figure 5:
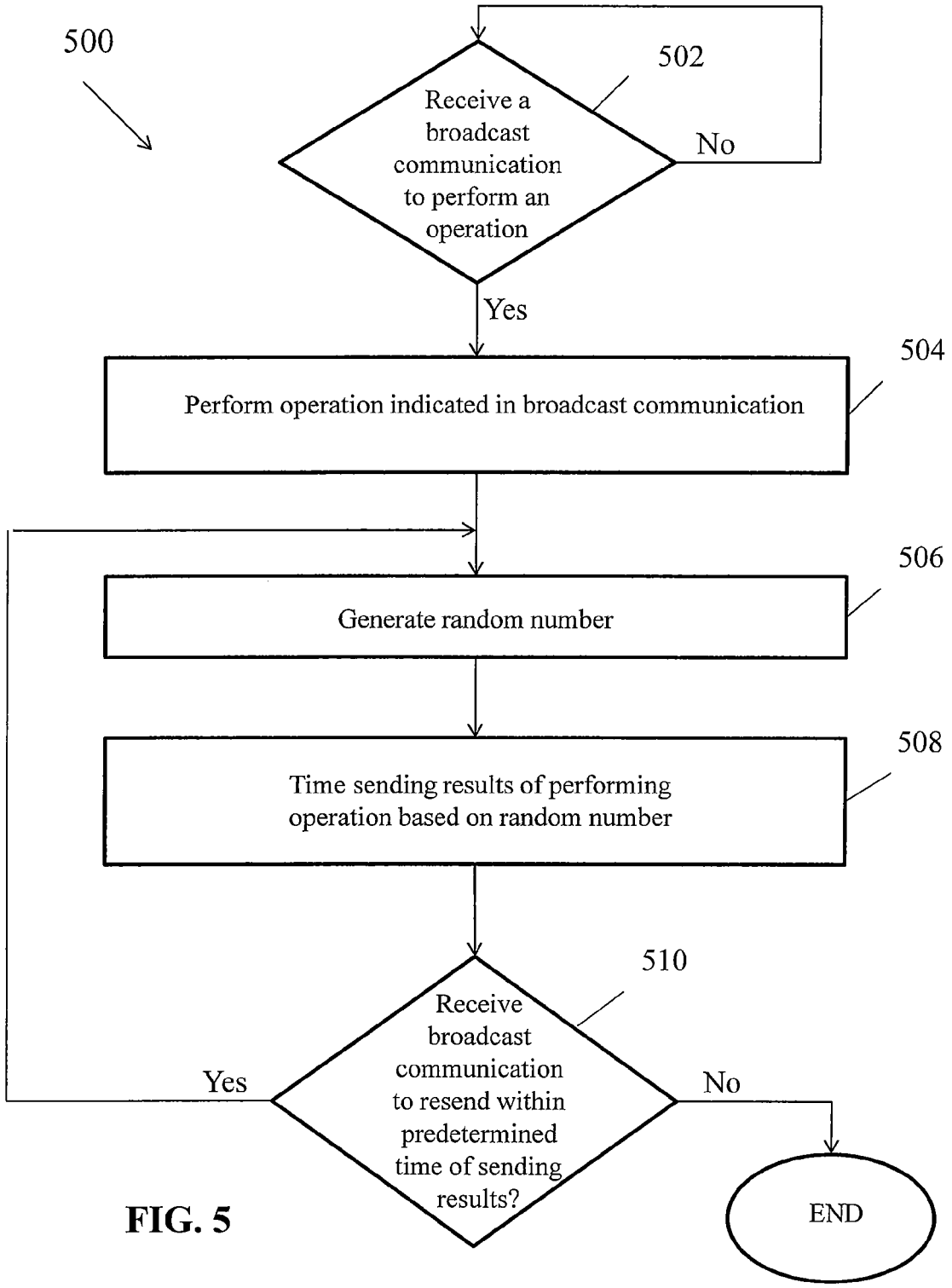
FIG. 5 illustrates a flow chart of an example of a non-addressable appliance receiving the broadcast command and sending a response to the system controller.

Another way to modify the one or more communication lines in response to receiving a broadcast communication is to send a communication on the one or more communication lines. The system controller 14, in turn, may receive the communication and act accordingly. FIG. 4 is a flow chart 400 of the operations from the perspective of the system controller 14, and FIG. 5 is a flow chart 500 of the operations from the perspective of the appliance.

Referring to FIG. 4, there is shown a flow chart 400 of another example of the system controller 14 overseeing one, some or all of the appliances in the system to perform a test. The example of the broadcast command being a test is merely for illustrative purposes. Other broadcast commands are contemplated.

As shown at block 402, the system controller 14 determines whether to perform a diagnostic test. If not, the system controller 14 loops back to block 402. If so, the system controller 14 broadcasts a command, as shown at block 404. The command may indicate to the received appliance to perform a test, and to report any failures in performing the test.

The system controller then determines whether it has received a communication, as shown at block 406. The communication may include data identifying the results of the test (such as whether the appliance has passed the test or not).

If the system controller 14 determines that it has received a communication, the system controller 14 determines if there was a clash of communications, as shown at block 410. Under this communication methodology, there is a possibility that different appliances may send communications at the same (or substantially the same) time, resulting in a clash of communications. The system controller 14 may determine if there is a clash of communications if the system controller is unable to decode the communication. For example, if the system controller 14 determines that it cannot decode the communication, the system controller 14 may determine that multiple appliances are sending a communication substantially simultaneously.

If the system controller 14 determines that there was a clash, the system controller may send another broadcast command requesting at least some of the appliances resend the communication. As one example, as shown at block 412, the broadcast command may indicate that the appliances that just sent the communication (which resulted in the clash) generate a random number, and then send the communication again with a delay based on the generated random number (such as wait a number of microseconds equal to the generated random number).

If the system controller 14 determines that there was not a clash, the system controller may optionally determine if it has received communications from all of the expected appliances, as shown at block 408. For example, the system controller 14 may send the broadcast communication to one appliance circuit or to multiple appliance circuits. The system controller 14 may further access a look-up table or other data structure in memory 38 to determine how many appliances are in one or multiple appliance circuits. If the system controller 14 determines that it has not received communications equal to the number of expected appliances, the process 400 loops back to block 406. If the system controller 14 determines that it has received communications from all of the appliances on the one appliance circuit or on the multiple appliance circuits, the process ends.

FIG. 5 is a flow chart 500 of the operations of the appliance. As shown at block 502, the appliance determines whether it has received a broadcast communication. If the appliance has not, the flow chart loops back to block 502. If a broadcast communication has been received, the appliance performs the operation indicated in the broadcast communication, as shown at block 504. For example, if the broadcast communication is indicative of requesting the appliance to perform a test, the appliance performs a test in response to receiving the broadcast communication.

The appliance may then generate a communication to send to the system controller. The communication may include data that is responsive to the received broadcast communication, such as the data resulting from the test performed by the appliance. Because of the possibility of a clash of communications (discussed, for example, in FIG. 4), the appliance may generate a random number, as shown at block 506, and then time sending the communication that includes the results of the performed operation based on the generated random number, as shown at block 508. For example, the appliance may generate a random integer number between 1 and 200, and may wait a number of microseconds equal to the generated random number. In this way, their respective different appliances that received the broadcast command can stagger sending the communications back to the system controller 14 in order to avoid clashes. Moreover, while generating a random number reduces the likelihood that there will be clashes in communications, it may not eliminate the possibility of a clash (for example, if two appliances generate the same random number). In this instance, there will be a clash in the communications. However, the system controller 14 may determine that there is a clash (for example, see block 410 in FIG. 4), and broadcast a request to re-send the communication. Thus, after sending the communication, the appliance may wait a predetermined amount of time to receive a new broadcast command indicating the appliance should resend its communication. If no broadcast command has been received within the predetermined amount of time, the process 500 ends. If a broadcast command has been received within the predetermined amount of time, the process 500 loops back to block 506. In this way, the appliance may generate another random number, and send its communication to the system controller 14 with a delay based on the random number, thereby reducing the likelihood that a clash occurs a second time.

As discussed above, there are a multitude of non-alarm type of commands to broadcast to the non-addressable appliances. One type, discussed above, is a broadcast test command. Another type is a mass notification command. As discussed above, notification appliances can output a visual notification, an audible notification, or both. Examples of notification appliances include, but are not limited to strobes, horns, speakers, and the like.

The fire alarm system may further include mass notification/emergency communication (MNEC) functionality. Unexpected emergency situations (such as a terrorist threat or an oncoming tornado) may require real-time widespread mass notification. Notification appliances within the fire alarm system, termed mass notification appliances, may be used for the widespread mass notification.

Prior fire alarm systems with MNEC functionality have used different ways in which to integrate the mass notification appliances within the fire alarm system. One way is to configure the mass notification appliances on wiring that is separate from fire alarm notification appliances. More specifically, in a non-addressable fire alarm system, the fire alarm control panel may activate the mass notification appliances by sending a command on the separate wiring.

In one aspect of the invention, one, some or all of the mass notification appliances are connected to the same wiring as the fire alarm notification appliances. Moreover, the system controller 14 sends specialized commands in order to command the mass notification appliances separately and distinctly from the fire alarm notification appliances on the same wiring, and/or to command the fire alarm notification appliances separately and distinctly from the mass notification appliances on the same wiring.

For example, the system controller 14 may send a broadcast command indicating that the current command is only to be executed by fire alarm notification appliances or indicating that the next broadcast command is only to be executed by fire alarm notification appliances. Each of the appliances may be pre-programmed or hard-wired to know whether it is a fire alarm notification appliance or a mass notification appliance. When the appliance receives a broadcast command indicating that the current command (or the next broadcast command) is only for fire alarm notification appliances, the appliance may review its programming, and determine whether it is a fire alarm notification appliance. If the appliance is not a fire alarm notification appliance, the appliance may ignore the current command (or the next broadcast command). Similarly, if the appliance is a fire alarm notification appliance, the appliance may execute the current command (or the next broadcast command).

As another example, the system controller 14 may send a broadcast command indicating that the current command is only to be executed by mass notification appliances or indicating that the next broadcast command is only to be executed by mass notification appliances. When the appliance receives a broadcast command indicative that the current command (or the next broadcast command) is only for mass notification appliances, the appliance may review its programming, and determine whether it is a mass notification appliance. If the appliance is not a mass notification appliance, the appliance may ignore the current command (or the next broadcast command). Similarly, if the appliance is a mass notification appliance, the appliance may execute the current command (or the next broadcast command).

As still another example, the system controller 14 may send a broadcast command that indicates that one, some, or all subsequent commands are for a particular type of appliance until notified otherwise (such as fire alarm notification appliances or mass notification appliances). For example, the system controller 14 may send a broadcast command that includes an indication that one, some or all subsequent commands are to be processed by fire alarm notification appliances. The system controller 14 may then send one or more subsequent commands, which the non-addressable appliances will then interpret only for fire alarm notification appliances. In particular, when a particular non-addressable appliance receives the subsequent command, the particular non-addressable appliance may access its memory to determine whether it is designated as a mass notification appliance or a fire alarm notification appliance. The particular non-addressable appliance may then determine whether its designation (whether mass notification or fire alarm notification) matches the indication in the broadcast command. If there's a match (the notification appliance is designated as a fire alarm notification appliance), the system controller processes the subsequent command. If there's not a match (the notification appliance is designated as a mass notification appliance), the system controller does not processes the subsequent command. The system controller 14 may subsequently send a broadcast command that the commands are no longer for fire alarm notification appliances (for example, the subsequent commands are for mass notification appliances).

As another example, the system controller 14 may send a broadcast command that indicates that all subsequent commands are for mass notification appliances. The system controller 14 may then send one or more subsequent commands, which the appliances will then interpret only for mass notification appliances. In particular, when a particular non-addressable appliance receives the subsequent command, the particular non-addressable appliance may access its memory to determine whether it is designated as a mass notification appliance or a fire alarm notification appliance. The particular non-addressable appliance may then determine whether its designation (whether mass notification or fire alarm notification) matches the indication in the broadcast command. If there's a match (the notification appliance is designated as a mass notification appliance), the system controller 14 processes the subsequent command. If there's not a match (the notification appliance is designated as a fire alarm notification appliance), the system controller does not processes the subsequent command. The system controller 14 may subsequently send a broadcast command that the commands are no longer for mass notification appliances (for example, the subsequent commands are for fire alarm notification appliances).

Instructions for controlling or commanding a device in the process discussed above, such as disclosed in FIGS. 3-5, may be stored on any logic. As used herein, "logic", includes but is not limited to hardware, firmware, software in execution on a machine, and/or combinations of each to perform a function (s) or an action(s), and/or to cause a function or action from another logic, method, and/or system. Logic may include, for example, a software/firmware-controlled microprocessor, an ASIC, an analog circuit, a digital circuit, a programmed logic device, and a memory device containing instructions.

Although specific embodiments have been described and illustrated, the invention is not to be limited to the specific forms or arrangements of parts so described and illustrated. The scope of the invention is to be defined by the claims appended hereto and their equivalents. It is intended that the foregoing detailed description be understood as an illustration of selected forms that the invention can take and not as a definition of the invention. It is only the following claims, including all equivalents, which are intended to define the scope of this invention.

The invention claimed is:

1. A method for a fire alarm control panel to communicate with a plurality of non-addressable appliances in a fire alarm system, the method comprising:

sending, via one or more communication lines, a broadcast command to the plurality of non-addressable appliances;

analyzing the one or more communication lines;

determining a response from one or more of the plurality of non-addressable appliances based on the analyzing of the one or more communication lines;

receiving an input to the fire alarm control panel indicative that at least one of the non-addressable appliances has been reset;

in response to receiving the input:

subsequently analyzing the one or more communication lines; and determining whether the response is still present based on the subsequently analyzing of the one or more communication lines.

2. The method of claim 1, wherein analyzing the one or more communication lines comprises determining whether the one or more communication lines has an open circuit.

3. The method of claim 2, wherein the broadcast command comprises a broadcast test command indicative of the plurality of non-addressable appliances to test at least one aspect; and wherein determining the response based on the analyzing of the one or more communication lines comprises determining that at least one of the plurality of non-addressable appliances has a fault if it is determined that the one or more communication lines has an open circuit.

4. The method of claim 3, wherein receiving an input to the fire alarm control panel comprises receiving an input indicating that the at least one of the plurality of non-addressable appliances that has a fault has been reset; and in response to receiving the input indicating the at least one of the plurality of non-addressable appliances that has a fault has been reset, determining whether the one or more communication lines still has an open circuit.

5. A method for a fire alarm control panel to communicate with a plurality of non-addressable appliances in a fire alarm system, the method comprising:

sending, via one or more communication lines, a broadcast command to the plurality of non-addressable appliances;

analyzing the one or more communication lines; and determining whether there is a clash in communications on the one or more communication lines.

6. The method of claim 5, further comprising, in response to determining that there was a clash in communications on the one or more communication lines, sending a re-send broadcast command commanding the non-addressable devices that sent the communications in the clash to resend the communications.

7. The method of claim 1, further comprising determining, by the fire alarm control panel of the fire alarm system, whether the fire alarm control panel has received communications from all expected appliances in response to the sending of the broadcast command.

8. A method for a non-addressable appliance to communicate with a fire alarm control panel in a fire alarm system, the method comprising:

receiving, via one or more communication lines, a broadcast command from the fire alarm control panel;

analyzing at least a part of the broadcast command;

sending a current on one or more communication lines in the fire alarm system in response to analyzing the at least a part of the broadcast command.

9. A method for a non-addressable notification appliance to process a mass notification broadcast command, the method comprising:

receiving the mass notification broadcast command;

in response to receiving the mass notification command, determining whether to accept or reject the mass notification command; and in response to determining to accept the mass notification command, performing at least one action.

10. The method of claim 9, wherein determining whether to accept or reject the mass notification command includes determining, by the non-addressable notification appliance, whether the non-addressable notification appliance is a mass notification appliance.

11. The method of claim 10, wherein the mass notification command includes a command to implement a subsequent command; and wherein performing the at least one action includes performing the subsequent command.

12. A method of testing plural non-addressable notification appliances on a notification appliance circuit, the method comprising:

receiving, by at least one of the notification appliances, a test request from a fire alarm control panel via the notification appliance circuit, the test request indicative of requesting a test by the fire alarm control panel;

executing, by the at least one of the notification appliances, the requested test in response to receipt of the test request;

determining, by the at least one of the notification appliances, if the test indicates a failure; and if the test indicates a failure, sending, by the at least one of the notification appliances, an indication of said failure via the notification appliance circuit, the indication for decoding by the fire alarm control panel.

13. The method of claim 12, wherein the test request comprises a broadcast test command communicated via the notification appliance circuit.

14. A fire alarm control panel configured to communicate with a plurality of non-addressable appliances in a fire alarm system, the fire alarm control panel comprising:

a communications interface for communicating with one or more alarm devices via one or more communication lines; and a controller in communication with the communications interface, the controller configured to:

send, via the one or more communication lines, a broadcast command to the plurality of non-addressable appliances;

analyze the one or more communication lines;

determine a response from one or more of the plurality of non-addressable appliances based on the analyzing of the one or more communication lines;

receive an input to the fire alarm control panel indicative that at least one of the non-addressable appliances has been reset;

in response to receiving the input:

subsequently analyze the one or more communication lines; and determine whether the response is still present based on the subsequently analyzing of the one or more communication lines.

15. The fire alarm control panel of claim 14, wherein the controller is configured to analyze the one or more communication lines by determining whether the one or more communication lines has an open circuit.

16. The fire alarm control panel of claim 14, wherein the controller is configured to analyze the one or more communication lines by receiving from the communications interface a communication from one or more of the plurality of non-addressable devices.

17. A non-addressable appliance configured to communicate with a fire alarm control panel in a fire alarm system, the non-addressable appliance comprising:

a communication interface configured to receive via one or more communication lines, a broadcast command from the fire alarm control panel; and a controller in communication with the communication interface and configured to:

analyze at least a part of the broadcast command;

send a current on one or more communication lines in the fire alarm system in response to analyzing the at least a part of the broadcast command.

18. A method for a non-addressable notification appliance to process a mass notification broadcast command or a fire alarm notification broadcast command, the method comprising:

receiving a broadcast command, the broadcast command including an indication that a subsequent broadcast command is to be interpreted as one of a mass notification broadcast command or a fire alarm notification broadcast command;

receiving a subsequent broadcast command; and determining whether to process or ignore the subsequent broadcast command based on the received broadcast command.

19. The method of claim 18, wherein determining whether to process or ignore the subsequent broadcast command based on the received broadcast command comprises:

determining whether the non-addressable notification appliance is a mass notification appliance or a fire alarm notification appliance;

determining whether the indication in the broadcast command matches the determination of whether the non-addressable notification appliance is a mass notification appliance or a fire alarm notification appliance; and processing the subsequent broadcast command if it is determined that the indication in the broadcast command matches the determination of whether the non-addressable notification appliance is a mass notification appliance or a fire alarm notification appliance.

20. The method of claim 1, wherein the fire alarm system comprises an appliance circuit, the appliance circuit including a plurality of non-addressable appliances in series;

wherein each of the plurality of non-addressable appliances includes an open circuit generating device;

wherein analyzing the one or more communication lines comprises determining whether there is an open circuit in the appliance circuit; and wherein the input is indicative that the at least one of the non-addressable appliances has been reset from an open-circuit configuration.

21. The method of claim 20, wherein the open circuit generating device comprises an isolator.

22. The fire alarm control panel of claim 14, wherein the fire alarm system comprises an appliance circuit, the appliance circuit including a plurality of non-addressable appliances in series;

wherein each of the plurality of non-addressable appliances includes an open circuit generating device;

wherein the controller is configured to analyze the one or more communication lines by determining whether there is an open circuit in the appliance circuit; and wherein the input is indicative that the at least one of the non-addressable appliances has been reset from an open-circuit configuration.

23. The fire alarm control panel of claim 22, wherein the open circuit generating device comprises an isolator.

* * * * *